US010205260B2

(12) United States Patent
Takemoto

(10) Patent No.: US 10,205,260 B2
(45) Date of Patent: Feb. 12, 2019

(54) ELECTRICAL CONNECTOR

(71) Applicant: DAI-ICHI SEIKO CO., LTD., Kyoto (JP)

(72) Inventor: Masatoshi Takemoto, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/801,970

(22) Filed: Nov. 2, 2017

(65) Prior Publication Data

US 2018/0166816 A1 Jun. 14, 2018

(30) Foreign Application Priority Data

Dec. 9, 2016 (JP) ..... 2016-239687

(51) Int. Cl.

| | |
|---|---|
| ***H01R 12/88*** | (2011.01) |
| ***H01R 12/78*** | (2011.01) |
| ***H01R 12/79*** | (2011.01) |
| *H01R 12/77* | (2011.01) |
| *H01R 13/629* | (2006.01) |

(52) U.S. Cl.

CPC ..... *H01R 12/88* (2013.01); *H01R 12/78* (2013.01); *H01R 12/79* (2013.01); *H01R 12/774* (2013.01); *H01R 13/62994* (2013.01)

(58) Field of Classification Search

CPC ..... H01R 12/79; H01R 12/88
USPC ..... 439/260, 495
See application file for complete search history.

(56) References Cited

U.S. PATENT DOCUMENTS 6,383,017 B1 * 5/2002 Takayasu ..... H01R 12/79 439/495
7,695,299 B2 * 4/2010 Tanaka ..... H01R 12/88 439/259

FOREIGN PATENT DOCUMENTS

JP 2001-307805 A 11/2001

* cited by examiner

*Primary Examiner* — Ross N Gushi
(74) *Attorney, Agent, or Firm* — Studebaker & Brackett PC

(57) ABSTRACT

An electrical connector including a housing, first and second conductive contacts arranged on the housing, and an actuator provided to be rotatable for taking up first and second stations selectively and to have a pressing portion for pressing down a flat circuit device put partially in the housing to contacting portions of the first and second conductive contacts, wherein the actuator has an engaging portion and a projecting portion, the first conductive contact has a supporting portion for engaging with the engaging portion of the actuator so as to support the actuator, and the second conductive contact has a stopper portion for engaging with the projecting portion of the actuator so as to prevent the projecting portion from shifting in a direction opposite to an insertion direction along which the flat circuit device is inserted into the housing to be put partially in the same.

6 Claims, 11 Drawing Sheets

ELECTRICAL CONNECTOR

BACKGROUND OF THE INVENTION

Field of the Invention

The present invention relates generally to electrical connectors, and more particularly to an improvement in an electrical connector provided to be fixed to and connected electrically with a circuit board device, such as a main solid circuit board of an electronic apparatus, and to have a plurality of conductive contacts for coming into press-contact with connecting terminals provided on a flat circuit device, such as a flexible printed circuit board (hereinafter, referred to as an FPC) or a flexible flat cable assembly (hereinafter, referred to as an FFC), so as to put the connecting terminals on the flat circuit device in electrical connection with the circuit board device.

Description of Related Art Including Information Disclosed Under 37 CFR 1.97 and 37 CFR 1.98

A flat circuit device, such as a relatively small-sized FPC or FFC, used in electronic apparatus of various kinds is often mounted on a circuit board device, on which various electrical parts are directly mounted, by means of an electrical connector which is fixed to and connected electrically with the circuit board device. The electrical connector has a plurality of conductive contacts for coming into contact with contacting terminals provided on the flat circuit device and is operative to connect electrically, through the conductive contacts, the contacting terminals provided on the flat circuit device with conductive circuit pattern portions provided on the circuit board device.

One of previously proposed electrical connectors, which is used for mounting a flat circuit device which is, for example, an FPC on a circuit board device, is provided with a housing made of insulator which has an opening through which the flat circuit device is inserted into the housing to be put partially in the housing and is to be mounted on the circuit board device. On the housing, a plurality of conductive contacts are provided to be arranged along a transverse direction of the opening. These conductive contacts are operative to come into contact respectively with a plurality of contacting terminals provided on the flat circuit device which has been inserted into the housing through the opening to be put partially in the housing. The electrical connector is further provided with an actuator which is provided to be rotatable in regard to the housing so as to engage with the flat circuit device put partially in the housing. When the actuator is rotated in regard to the housing under a condition wherein the flat circuit device is put partially in the housing, the flat circuit device is pressed down by the actuator to the conductive contacts arranged on the housing so that each of the conductive contacts is put in press-contact with a corresponding one of the contacting terminals provided on the flat circuit device.

The actuator is formed into a slender shape elongating in a direction along which the conductive contacts are arranged and provided with an engaging portion for engaging with at least a part of the conductive contacts to be supported by the part of the conductive contacts and a pressing portion for coming into contact with the flat circuit device so as to press down the flat circuit device. Then, the actuator is operative to take up selectively a first station to keep rising from the housing and a second station to keep lying down on the housing with its rotational movement in regard to the housing.

Each of the conductive contacts arranged on the housing is made of conductive resilient material to have a connecting terminal portion to be connected electrically, for example, by means of soldering, with a conductive circuit pattern portion provided on the circuit board device on which the housing is mounted and a contacting portion for coming into press-contact with the contacting terminal provided on the flat circuit device. Further, each of the part of the conductive contacts is provided with a supporting portion for coming into engagement with the engaging portion of the actuator so as to support the actuator as a whole. Under such a condition, the actuator is supported with the conductive contacts arranged on the housing to be rotatable in regard to the housing.

In the electrical connector as mentioned above, when the flat circuit device has been inserted into the housing through the opening provided thereon to be put partially in the housing and the actuator is rotated in a predetermined direction from the first station to the second station, the actuator operates to cause the pressing portion thereof to come into contact with the flat circuit device put partially in the housing and to press down the flat circuit device to the contacting portions provided respectively on the conductive contacts, so that the contacting portion of each of the conductive contacts is put in press-contact with the corresponding one of the contacting terminals provided on the flat circuit device. Therefore, the second station which the actuator takes up is a station wherein the actuator is put in press-operation in case the flat circuit device is put partially in the housing.

Then, when the actuator is rotated in a direction opposite to the above-mentioned predetermined direction from the second station to the first station under a condition wherein the contacting portion of each of the conductive contacts has been put in press-contact with the corresponding one of the contacting terminals provided on the flat circuit device, the actuator operates to cause the pressing portion thereof to separate from the flat circuit device put partially in the housing and to cease pressing down the flat circuit device, so that the contacting portion of each of the conductive contacts is released from the press-contact with the corresponding one of the contacting terminals provided on the flat circuit device. Therefore, the first station which the actuator takes up is a station wherein the actuator is released from the press-operation in case the flat circuit device is put partially in the housing.

In the electrical connector thus proposed previously, it is possible for the actuator to be manipulated to rotate from the first station wherein the actuator is released from the press-operation in case the flat circuit device is put partially in the housing to the second station wherein the actuator is put in the press-operation in case the flat circuit device is put partially in the housing under a condition wherein any flat circuit device is not put in the housing. A manipulation for causing the actuator to rotate from the first station to the second station under the condition wherein the flat circuit device is not put in the housing, is hereinafter referred to as a vacancy-press operation.

When the vacancy-press operation has been carried out and then the actuator is caused to rotate from the second station to the first station so that the flat circuit device is able to be inserted into the housing through the opening provided thereon, since the pressing portion of the actuator does not come into contact with the flat circuit device, it is likely that the actuator brings about deflections thereon and thereby the engaging portion of the actuator is disengaged from the supporting portions provided on the part of the conductive contacts to be released from the support by the part of the conductive contacts so that the actuator as a whole loses the support by the conductive contacts arranged on the housing to be separated from the conductive contacts. Especially, in the case where a large number of conductive contacts are arranged on the housing which has the elongated length thereof in the direction along which the conductive contacts are arranged, the actuator is apt to be caused to lose the support by the conductive contacts arranged on the housing so as to be separated from the conductive contacts by the vacancy-press operation and the rotation of the actuator from the second station to the first station carried out after the vacancy-press operation.

Accordingly, there has been also proposed previously an electrical connector comprising a housing made of insulator provided thereon with an opening through which a flat circuit device is inserted into the housing to be put partially in the same, a plurality of conductive contacts arranged on the housing, and an actuator supported by the conductive contacts to be rotatable in regard to the housing, which is so improved that the actuator is prevented from being disengaged from the conductive contacts even when the vacancy-press operation is carried out and then the actuator is caused to rotate from a station wherein the actuator is put in press-operation in case the flat circuit device is put partially in the housing to another station wherein the actuator is released from the press-operation in case the flat circuit device is put partially in the housing under a condition wherein the flat circuit device is not put in the housing, as shown in, for example, the Japanese patent application published before examination under publication number 2001-307805 (hereinafter, referred to as a published Japanese patent document).

In the previously proposed electrical connector shown in the above-mentioned published Japanese patent document, a plurality of first conductive contacts (terminals (10)) and a plurality of second conductive contacts (terminals (20)) are arranged alternately on a housing (1) which is provided to be mounted on a circuit board device and an actuator (a pressurizing member (30)) is provided to be rotatable in regard to the housing (1). The actuator is formed into a slender shape elongating in a direction along which the first and second conductive contacts (10, 20) are arranged and operative to take up selectively a first station (an opening station) to keep rising from the housing (1) and a second station (a closing station) to keep lying down on the housing (1) with its rotational movement in regard to the housing (1) from the first station to the second station or from the second station to the first station.

Each of the first conductive contacts (10) has an upper arm (11), on which a finger-like portion (11A) is provided for engaging with the actuator (30), and a lower arm (12), on which a contacting portion (12B) is provided for coming into contact with a corresponding one of contacting terminals (connecting circuit portions) provided on a flat circuit device (a flexible circuit board (P)) inserted into the housing (1) to be put partially in the same. Further, each of the second conductive contacts (20) has an upper arm (21), on which a slant portion (21A) is provided for engaging with the actuator (30), and a lower arm (22), on which a contacting portion (22A) is provided for coming into contact with another corresponding one of contacting terminals provided on the flat circuit device (P) put partially in the housing (1). The finger-like portion (11A) provided on the upper arm (11) of the first conductive contact (10) is operative to engage with a first engaging portion (31A) provided on the actuator (30) from the upper side of the same and the slant portion (21A) provided on the upper arm (21) of the second conductive contact (20) is operative to engage with a second engaging portion (32A) provided on the actuator (30) from the lower side of the same.

Consequently, the actuator (30) is supported by both of the finger-like portion (11A) provided on the upper arm (11) of the first conductive contact (10) for engaging with the first engaging portion (31A) of the actuator (30) from the upper side of the same and the slant portion (21A) provided on the upper arm (21) of the second conductive contact (20) for engaging with the second engaging portion (32A) of the actuator (30) from the lower side of the same, so as to be rotatable for shifting from the first station to the second station or from the second station to the first station. Therefore, the first engaging portion (31A) and the second engaging portion (32A) provided on the actuator (30) constitute an engaging device provided to be supported by a certain device, and the finger-like portion (11A) provided on the upper arm (11) of the first conductive contact (10) and the slant portion (21A) provided on the upper arm (21) of the second conductive contact (20) constitute a supporting device for supporting the engaging device of the actuator (30).

When the actuator (30) is rotated in regard to the housing (1) from the first station to the second station under a condition wherein the flat circuit device (P) has been inserted into the housing (1) to be put partially in the same, the flat circuit device (P) is pressed down by a pressing portion (a pressurizing portion (33)) provided on the actuator (30) so that each of the contacting portion (12B) provided on the lower arm (12) of the first conductive contact (10) and the contacting portion (22A) provided on the lower arm (22) of the second conductive contact (20) is put in press-contact with the contacting terminal provided on the flat circuit device (P) put partially in the housing (1). Then, when the actuator (30) is rotated in regard to the housing (1) from the second station to the first station under the condition wherein the flat circuit device (P) has been inserted into the housing (1) to be put partially in the same, the pressing portion (33) provided on the actuator (30) is operative to cease pressing down the flat circuit device (P) so that each of the contacting portion (12B) provided on the lower arm (12) of the first conductive contact (10) and the contacting portion (22A) provided on the lower arm (22) of the second conductive contact (20) is released from the condition of press-contact with the contacting terminal provided on the flat circuit device (P) put partially in the housing (1).

With the electrical connector proposed previously as shown in the above-mentioned published Japanese patent document, in which the first and second conductive contacts are arranged alternately on the housing, since the actuator is supported by both of the upper arm of each of the first conductive contacts engaging with the actuator from the upper side of the same and the upper arm of each of the second conductive contacts engaging with the actuator from the lower side of the same, it is expected that the actuator is prevented from being disengaged from the first and second conductive contacts even when the vacancy-press operation is carried out and then the actuator is caused to rotate from the second station to the first station under the condition wherein the flat circuit device is not put in the housing. However, under the above-mentioned condition wherein it is expected that the actuator is prevented from being disengaged from the first and second conductive contacts, there are the following apprehension on manipulation of the actuator.

That is, in the improved electrical connector proposed previously as described above which is provided with the first and second conductive contacts arranged alternately on the housing, the actuator is supported by both of the upper arm of each of the first conductive contacts engaging with the actuator from the upper side of the same and the upper arm of each of the second conductive contacts engaging with the actuator from the lower side of the same, and therefore, in case the actuator has been deformed to warp in a direction perpendicular to the direction along which the first and second conductive contacts are arranged, it is feared that a rotational movement of the actuator is subjected to resistances by the upper arm of each of the first conductive contacts and the upper arm of each of the second conductive contacts so that it is very hard to manipulate the actuator to rotate from the first station to the second station or from the second station to the first station or it is almost impossible to manipulate suitably the actuator to rotate from the first station to the second station or from the second station to the first station.

A situation wherein the actuator is deformed to warp in the direction perpendicular to the direction along which the first and second conductive contacts are arranged, is easily caused in the case where a large number of first and second conductive contacts are arranged on the housing and thereby the length of the actuator is elongated in the direction along which the first and second conductive contacts are arranged. Consequently, the above mentioned apprehension on manipulation of the actuator is easily brought about in the case where the actuator has the elongated length thereof in the direction along which the first and second conductive contacts are arranged.

BRIEF SUMMARY OF THE INVENTION

Accordingly, it is an object of the present invention to provide an electrical connector which comprises a housing made of insulator and provided with an opening through which a flat circuit device is inserted into the housing to be put partially in the same, a plurality of conductive contacts provided to be arranged on the housing, and an actuator provided to be supported by the conductive contacts so as to be rotatable in regard to the housing for shifting either from a first station to a second station or from the second station to the first station and is operative to cause the conductive contacts to come into press-contact with contacting terminals provided on the flat circuit device when the actuator is rotated from the first station to the second station under a condition wherein the flat circuit device is put partially in the housing, and which avoids the aforementioned disadvantages encountered with the prior art.

Another object of the present invention is to provide an electrical connector which comprises a housing made of insulator and provided with an opening through which a flat circuit device is inserted into the housing to be put partially in the same, a plurality of conductive contacts provided to be arranged on the housing, and an actuator provided to be supported by the conductive contacts so as to be rotatable in regard to the housing for shifting either from a first station to a second station or from the second station to the first station and is operative to cause the conductive contacts to come into press-contact with contacting terminals provided on the flat circuit device when the actuator is rotated from the first station to the second station under a condition wherein the flat circuit device is put partially in the housing, and with which the actuator can be prevented from being disengaged from the conductive contacts without any hindrance on manipulation of the actuator even when a vacancy-press operation is carried out and then the actuator is caused to rotate for shifting from the second station to the first station under a condition wherein the flat circuit device is not put in the housing.

A further object of the present invention is to provide an electrical connector which comprises a housing made of insulator and provided with an opening through which a flat circuit device is inserted into the housing to be put partially in the same, a plurality of conductive contacts provided to be arranged on the housing, and an actuator provided to be supported by the conductive contacts so as to be rotatable in regard to the housing for shifting either from a first station to a second station or from the second station to the first station and is operative to cause the conductive contacts to come into press-contact with contacting terminals provided on the flat circuit device when the actuator is rotated from the first station to the second station under a condition wherein the flat circuit device is put partially in the housing, and which avoids hindrance on manipulation of the actuator even when the actuator is deformed to warp in a direction perpendicular to a direction along which the conductive contacts are arranged.

A still further object of the present invention is to provide an electrical connector which comprises a housing made of insulator and provided with an opening through which a flat circuit device is inserted into the housing to be put partially in the same, a plurality of conductive contacts provided to be arranged on the housing, and an actuator provided to be supported by the conductive contacts so as to be rotatable in regard to the housing for shifting either from a first station to a second station or from the second station to the first station and is operative to cause the conductive contacts to come into press-contact with contacting terminals provided on the flat circuit device when the actuator is rotated from the first station to the second station under a condition wherein the flat circuit device is put partially in the housing, and with which the actuator can be prevented from being disengaged from the conductive contacts even when a vacancy-press operation is carried out and then the actuator is caused to rotate from the second station to the first station under a condition wherein the flat circuit device is not put in the housing and it can be made easy to manipulate the actuator to rotate for shifting either from the first station to the second station or from the second station to the first station even when the actuator is deformed to warp in a direction perpendicular to a direction along which the conductive contacts are arranged.

According to the present invention, as claimed in any one of claims, there is provided an electrical connector, which comprises a housing made of insulator to have a plane portion facing an opening through which a flat circuit device is inserted along a predetermined insertion direction to be put partially in the housing, a plurality of first and second conductive contacts arranged on the housing in a predetermined manner of arrangement, each of which has a contacting portion for coming into contact with a corresponding one of contacting terminals provided on the flat circuit device put partially in the housing, and an actuator provided to be rotatable in regard to the housing for shifting either from a first station to a second station or from the second station to the first station and to have a pressing portion for pressing down the flat circuit device put partially in the housing to the contacting portions of the first and second conductive contacts, the pressing portion of which being caused to press down the flat circuit device so that the contacting portions of the first and second conductive contacts are put in press-contact respectively with the contacting terminals provided on the flat circuit device when the actuator is rotated to shift from the first station to the second station under a condition wherein the flat circuit device is put partially in the housing, wherein the actuator is provided with an engaging portion for engaging with the first conductive contact and a projecting portion for facing the second conductive contact, and wherein each of the first conductive contacts is provided with a supporting portion for engaging with the engaging portion of the actuator so as to support the actuator and each of the second conductive contacts is provided with a stopper portion for engaging with the projecting portion of the actuator so as to prevent the projecting portion from shifting in a direction opposite to the predetermined insertion direction of the flat circuit device when the actuator is distorted and so positioned in the vicinity of the first station as to be perpendicular to the plane portion of the housing on the occasion of taking up the first station.

In the electrical connector thus constituted in accordance with the present invention, under a condition wherein the first and second conductive contacts are arranged on the housing, the actuator is provided to be rotatable in regard to the housing and the flat circuit device is put partially in the housing, the pressing portion of the actuator is caused to press down the flat circuit device so that the contacting portions of the first and second conductive contacts are put in press-contact respectively with the contacting terminals provided on the flat circuit device when the actuator is rotated to shift from the first station to the second station. On this occasion, the supporting portion provided on each of the first conductive contacts is operative to engage with the engaging portion provided on the actuator so as to support the actuator as a whole and thereby the actuator is supported by the first conductive contacts to be rotatable in regard to the housing.

The actuator is provided thereon the projecting portion facing each of the second conductive contacts and each of the second conductive contacts is provided thereon with the stopper portion for engaging with the projecting portion of the actuator so as to prevent the projecting portion from shifting in the direction opposite to the predetermined insertion direction of the flat circuit device when the actuator is distorted and so positioned in the vicinity of the first station as to be perpendicular to the plane portion of the housing on the occasion of taking up the first station.

In the arrangement of the first and second conductive contacts on the housing, the first and second conductive contacts are positioned, for example, in such a manner that the second conductive contacts appear at intervals of a predetermined number of the first conductive contacts, wherein a manner of arrangement in which the first and second conductive contacts are appear alternately is included. Then, the engaging portion of the actuator is formed into, for example, an axis-like portion and the supporting portion of the first conductive contact is formed into, for example, a hook-shaped portion. Further, the projecting portion of the actuator is provided with, for example, a slant surface which faces the stopper portion of the second conductive contact when the actuator is put in the first station or positioned in the vicinity of the first station.

In one embodiment of the electrical connector according to the present invention, a lengthwise direction of the actuator is coincident with the direction along which the first and second conductive contacts are arranged on the housing and the actuator is operative to rotate about an imaginary axis extending along the lengthwise direction of the actuator for shifting from the first station to the second station or from the first station to the first station.

With the electrical connector according to the present invention as described above, when the actuator is rotated to shift from the first station to the second station under the condition wherein the flat circuit device is put partially in the housing and thereby the pressing portion of the actuator is caused to press down the flat circuit device so that the contacting portions of the first and second conductive contacts are put in press-contact respectively with the contacting terminals provided on the flat circuit device, the actuator is not supported by, for example, the first conductive contacts each engaging with the actuator from the upper side of the same and the second conductive contacts each engaging with the actuator from the lower side of the same, but supported to be rotatable by the supporting portion provided on each of the first conductive contacts for engaging with the engaging portion of the actuator, and accordingly, any hindrance on manipulation of the actuator can be avoided even when the actuator is deformed to warp in the direction perpendicular to the direction along which the conductive contacts are arranged.

In addition, with the electrical connector according to the present invention, since the actuator is provided thereon the projecting portion facing each of the second conductive contacts and each of the second conductive contacts is provided thereon with the stopper portion for engaging with the projecting portion of the actuator so as to prevent the projecting portion from shifting in the direction opposite to the predetermined insertion direction of the flat circuit device when the actuator is distorted on the occasion of taking up the first station, the actuator can be prevented from moving in the direction opposite to the predetermined insertion direction of the flat circuit device so as to be disengaged from the first and second conductive contacts even when the vacancy-press operation is carried out and then the actuator is caused to rotate for shifting from the second station to the first station under the condition wherein the flat circuit device is not put in the housing so that the actuator is distorted on the occasion of taking up the first station.

Further, in the electrical connector according to the present invention, in case the first and second conductive contacts are positioned in such a manner that, in the arrangement of the first and second conductive contacts, the second conductive contacts appear at intervals of a predetermined number of the first conductive contacts, wherein the manner of arrangement in which the first and second conductive contacts appear alternately is included, the condition wherein the actuator is supported to be rotatable by the supporting portion provided on each of the first conductive contacts for engaging with the engaging portion of the actuator and the condition wherein the actuator is prevented from moving in the direction opposite to the predetermined insertion direction of the flat circuit device by the stopper portion of the second conductive contact put in engagement with the projecting portion of the actuator, are obtained in the well-balanced manner over the arrangement of the first and second 15 conductive contacts on the housing on the whole. Then, in case the engaging portion of the actuator is formed into the axis-like portion and the supporting portion of the first conductive contact is formed into the hook-shaped portion, the actuator is more surely supported by the first conductive contacts each having the supporting portion provided for engaging with the engaging portion of the actuator. Besides, in case the projecting portion of the actuator is provided with the slant surface which faces the stopper portion of the second conductive contact when the actuator is put in the first station or positioned in the vicinity of the first station, the stopper portion of the second conductive contact comes into contact with the slant surface of the projecting portion of the actuator when the actuator is distorted and so positioned in the vicinity of the first station as to be perpendicular to the plane portion of the housing on the occasion of taking up the first station and thereby the actuator is more surely and smoothly prevented from moving in the direction opposite to the predetermined insertion direction of the flat circuit device by the stopper portion of the second conductive contact in contact with the slant surface of the projecting portion of the actuator.

The above, and other objects, features and advantages of the present invention will become apparent from the following detailed description taken in conjunction with the accompanying drawings.

DETAILED DESCRIPTION OF THE INVENTION

Figure 1:
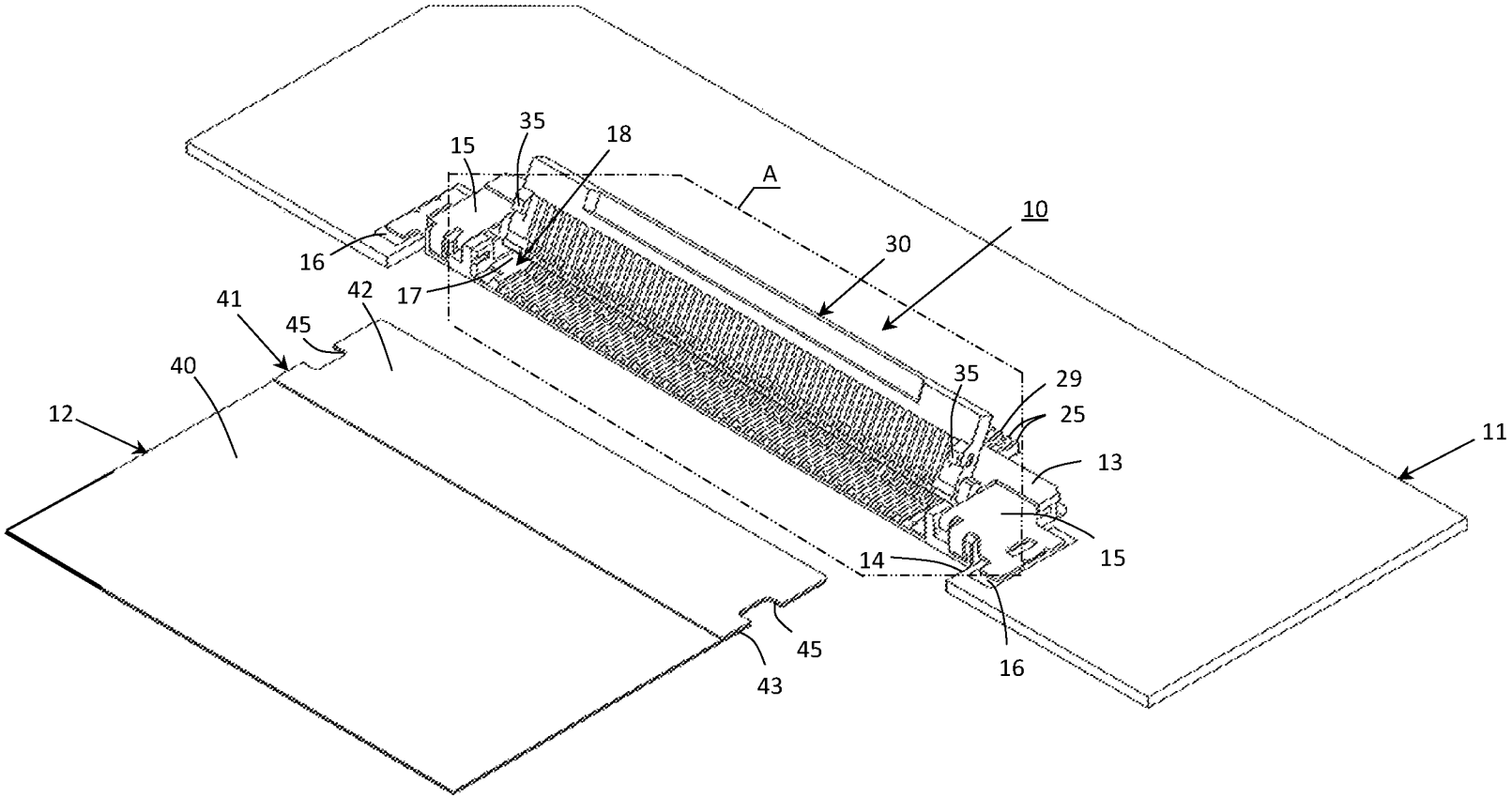
FIG. 1 is a schematic perspective view showing an embodiment of electrical connector according to the present invention, together with a circuit board device to which the embodiment is fixed and an FPC which is to be loaded in the embodiment as a flat circuit device.
Figure 2:
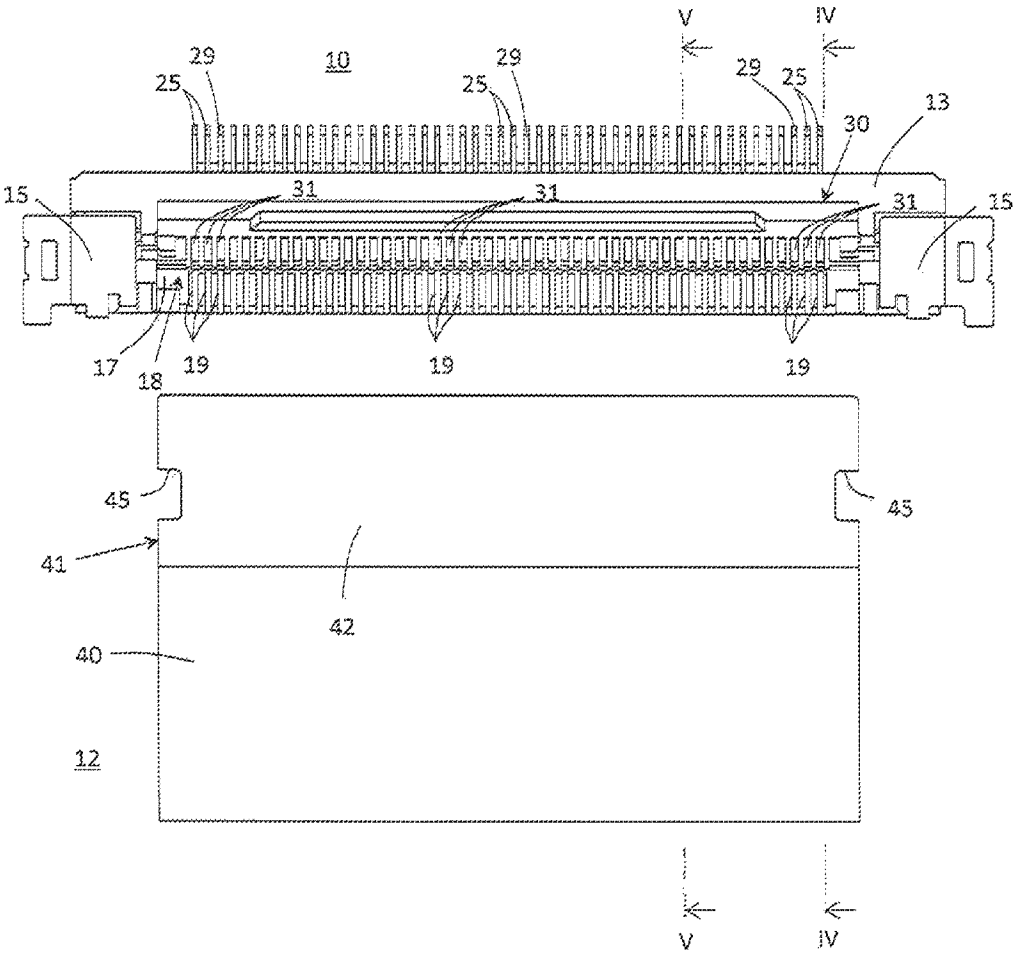
FIG. 2 is a schematic plan view showing the embodiment of electrical connector shown in FIG. 1 and the FPC which is to be loaded in the embodiment.

FIG. 1 shows an electrical connector 10, which constitutes an embodiment of electrical connector according to the present invention, together with a circuit board device 11 to which the electrical connector 10 is fixed and an FPC 12 which is to be loaded in the electrical connector 10 as a flat circuit device, and FIG. 2 shows the electrical connector 10 and the FPC 12 which is to be loaded in the electrical connector 10.

Referring to FIGS. 1 and 2, the electrical connector 10 has a housing 13 which is made of insulator, such as plastics or the like, to be mounted on the circuit board device 11 and in which the FPC 12 is to be put partially. The circuit board device 11 is provided thereon with a cut-out space 14 formed by cutting out a relatively large piece from the circuit board device 11 and the housing 13 of the electrical connector 10 is fitted in the cut-out space 14 on the circuit board device 11. A couple of mounting brackets 15 are provided on the circuit board device 11 in such a manner that a part of each of the mounting brackets 15 is, for example, soldered to a connector mounting portion 16 provided on the circuit board device 11 so that the each of the mounting brackets 15 overhangs the cut-out space 14. The housing 13 of the electrical connector 10 fitted in the cut-out space 14 provided on the circuit board device 11 is stably supported by the mounting brackets 15.

Figure 3:
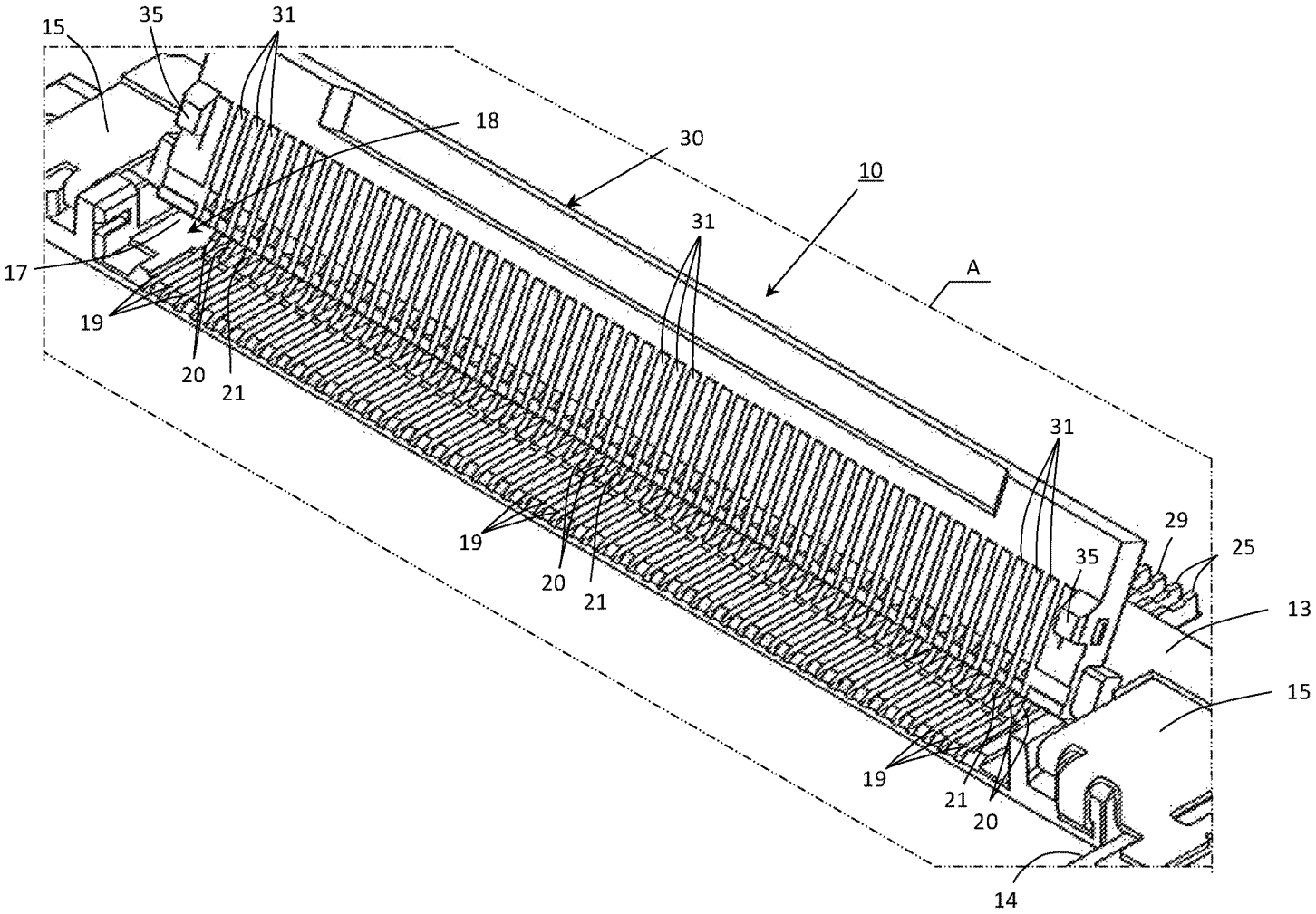
FIG. 3 is a schematic enlarged perspective view showing a part of the embodiment of electrical connector appearing in two-dot chain frame A in FIG. 1

The housing 13 has a plane portion 18 facing an opening 17 through which the FPC 12 is inserted into the housing 13 and the FPC 12 inserted through the opening 17 into the housing 13 to be put partially in the same. As shown in FIG. 3 showing a part of the electrical connector 10 appearing in two-dot chain frame A in FIG. 1, the plane portion 18 is provided with a plurality of grooves 19 arranged along a longitudinal direction of the housing 13 and each of the grooves 19 elongates along an insertion direction of the FPC 12 along which the FPC 12 is inserted through the opening 17 into the housing 13 or a pulling-out direction of the FPC 12 along which the FPC 12 is pulled out through the opening 17 from the housing 13.

Further, as shown in FIG. 3, a plurality of first conductive contacts 20 and a plurality of second conductive contacts 21 are arranged on the housing 13 in the longitudinal direction of the same. A part of each of the first and second conductive contacts 20 and 21 is put in a corresponding one of the grooves 19. Accordingly, a direction along which the first and second conductive contacts 20 and 21 are arranged (hereinafter, referred to as a contact-arrangement direction) is coincident with the longitudinal direction of the housing 13.

Figure 4:
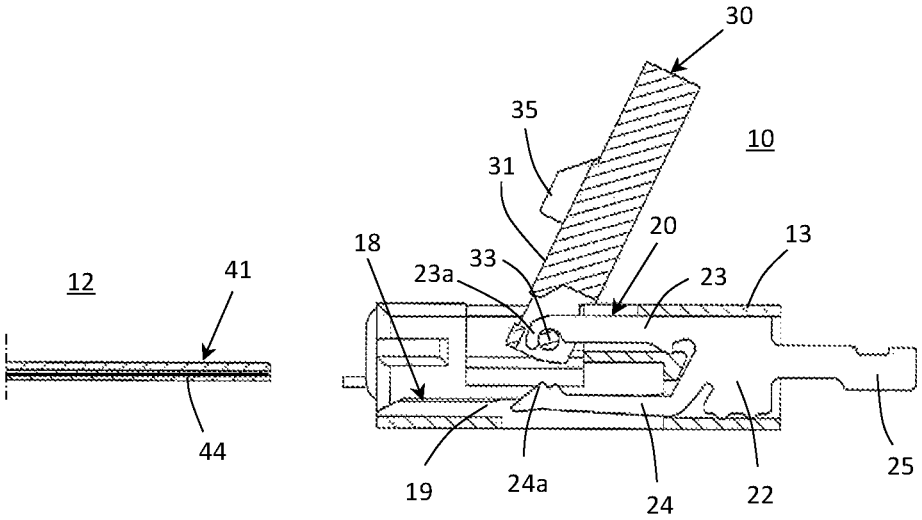
FIG. 4 is a schematic cross sectional view taken along line IV-IV in FIG. 2.

With the electrical connector 10 shown in FIGS. 1 to 3, in the arrangement of the first and second conductive contacts 20 and 21, the second conductive contacts 21 appear at intervals of two first conductive contacts 20 so that each of the second conductive contacts 21 is put between a pair of first conductive contacts 20. However, as for the arrangement of the first and second conductive contacts 20 and 21 in the electrical connector according to the present invention, a manner of the arrangement of the first and second conductive contacts 20 and 21 is not limited to the manner shown in FIGS. 1 to 3 and it is also possible to cause the first and second conductive contacts 20 and 21 to be arranged in such a manner that the second conductive contacts 21 appear at intervals of a predetermined number of first conductive contacts 20, wherein a manner of arrangement in which the first and second conductive contacts 20 and 21 appear alternately is included Each of the first conductive contacts 20 is made of resilient conductive material to be shaped as a whole into a plate-like member and to have a stationary portion 22 fixed to the housing 13 and a pair of arm 23 and 24 each extended from the stationary portion 22, as shown in FIG. 4 showing a cross section taken along line IV-IV in FIG. 2. The arm 23 is fixed to the housing 13 and provided thereon with a supporting portion 23*a* formed into a hook-shaped portion for engaging with an actuator 30 described later. The arm 24 is formed to be an operating portion shiftable resiliently in regard to the housing 13 and provided thereon a contacting portion 24*a* for coming into contact with a corresponding one of contacting terminals 44 (explained later) provided on the FPC 12 inserted through the opening 17 into the housing 13 to be put partially in the same. A part of the arm 24 on which the contacting portion 24*a* is provided is put in a corresponding one of the grooves 19 provided on the plane portion 18 of the housing 13.

Under such a structural condition, a part of the contacting portion 24*a* provided on the arm 24 projects from the groove 19 to the outside of the plane portion 18 and the stationary portion 22 of each of the first conductive contact 20 is provided thereon with a connecting terminal 25 extended from the stationary portion 22 to the outside of the housing 13 to be, for example, soldered to a conductive circuit pattern portion (not shown in the drawings) provided on the circuit board device 11.

Figure 5:
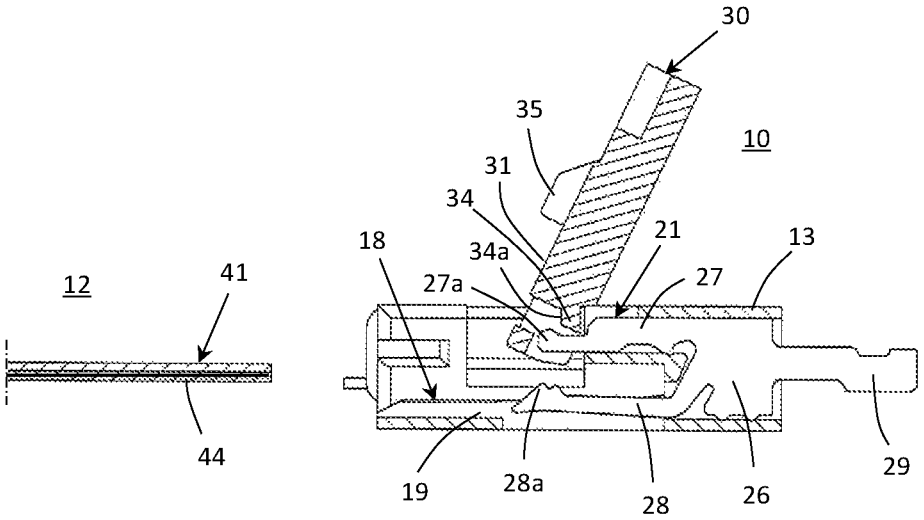
FIG. 5 is a schematic cross sectional view taken along line V-V in FIG. 2.

Each of the second conductive contacts 21 is also made of resilient conductive material to be shaped as a whole into a plate-like member and to have a stationary portion 26 fixed to the housing 13 and a pair of arm 27 and 28 each extended from the stationary portion 26, as shown in FIG. 5 showing a cross section taken along line V-V in FIG. 2. The arm 27 is fixed to the housing 13 and provided thereon with a stopper portion 27*a* formed into a protrusion having a curved surface for preventing the actuator 30 from disengaging from the first and second conductive contacts 20 and 21. The arm 28 is formed to be an operating portion shiftable resiliently in regard to the housing 13 and provided thereon a contacting portion 28*a* for coming into contact with a corresponding one of the contacting terminals 44 provided on the FPC 12 inserted through the opening 17 into the housing 13 to be put partially in the same. A part of the arm 28 on which the contacting portion 28*a* is provided is put in a corresponding one of the grooves 19 provided on the plane portion 18 of the housing 13.

Under such a structural condition, a part of the contacting portion 28*a* provided on the arm 28 projects from the groove 19 to the outside of the plane portion 18 and the stationary portion 26 of each of the first conductive contact 20 is provided thereon with a connecting terminal 29 extended from the stationary portion 26 to the outside of the housing 13 to be, for example, soldered to the conductive circuit pattern portion provided on the circuit board device 11.

The electrical connector 10 has, in addition to the housing 13, the actuator 30 which is provided to be rotatable in regard to the housing 13. The actuator 30 is shaped into a long and narrow member elongating in the contact-arrangement direction, that is, the longitudinal direction of the housing 13, so that a lengthwise direction of the actuator 30 is coincide with the longitudinal direction of the housing 13.

Figure 9:
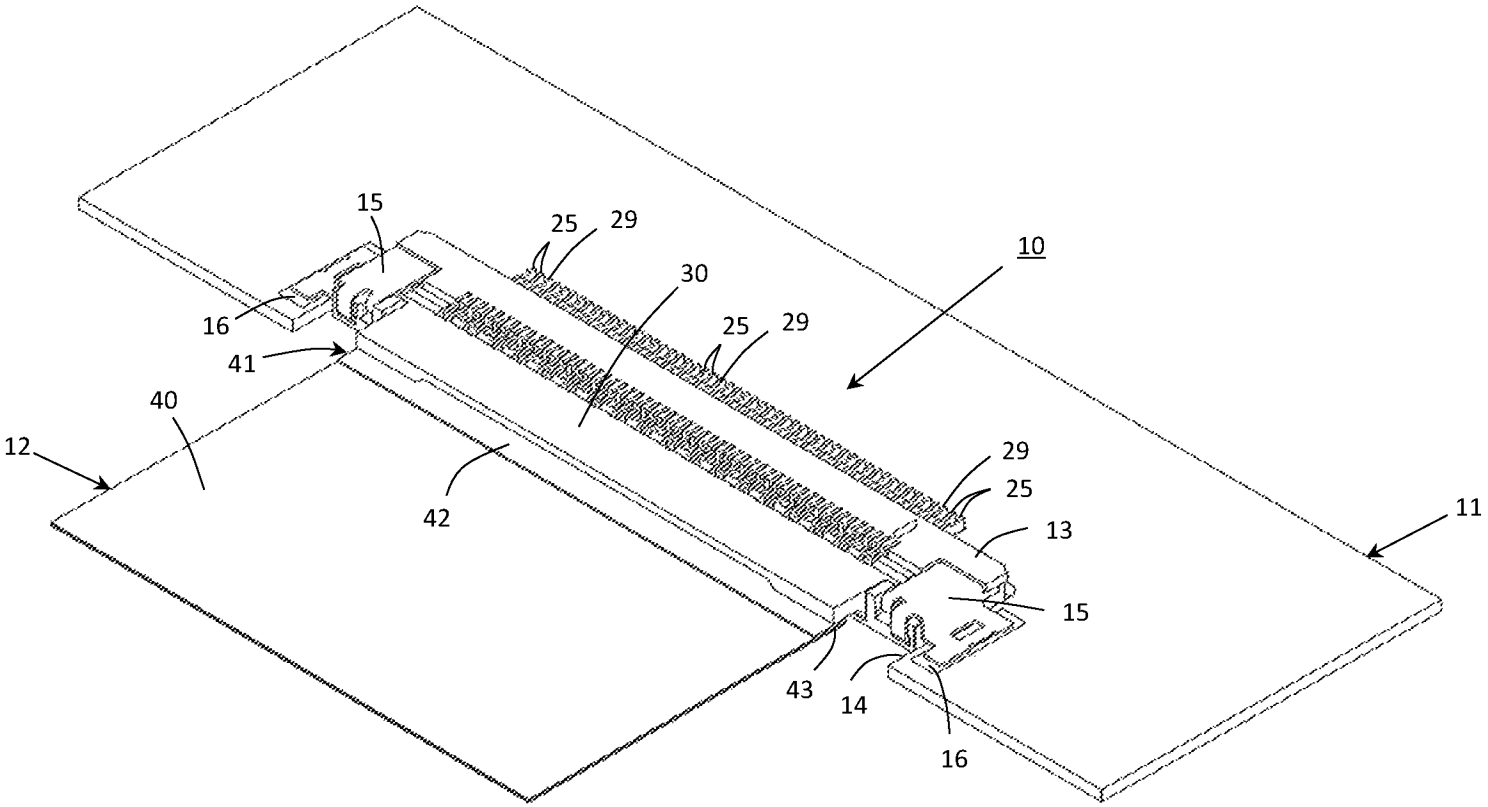
FIG. 9 is a schematic perspective view showing a condition wherein the FPC is put partially in the embodiment of electrical connector fixed to the circuit board device and the actuator of the embodiment of electrical connector is put in a second station.
Figure 10:
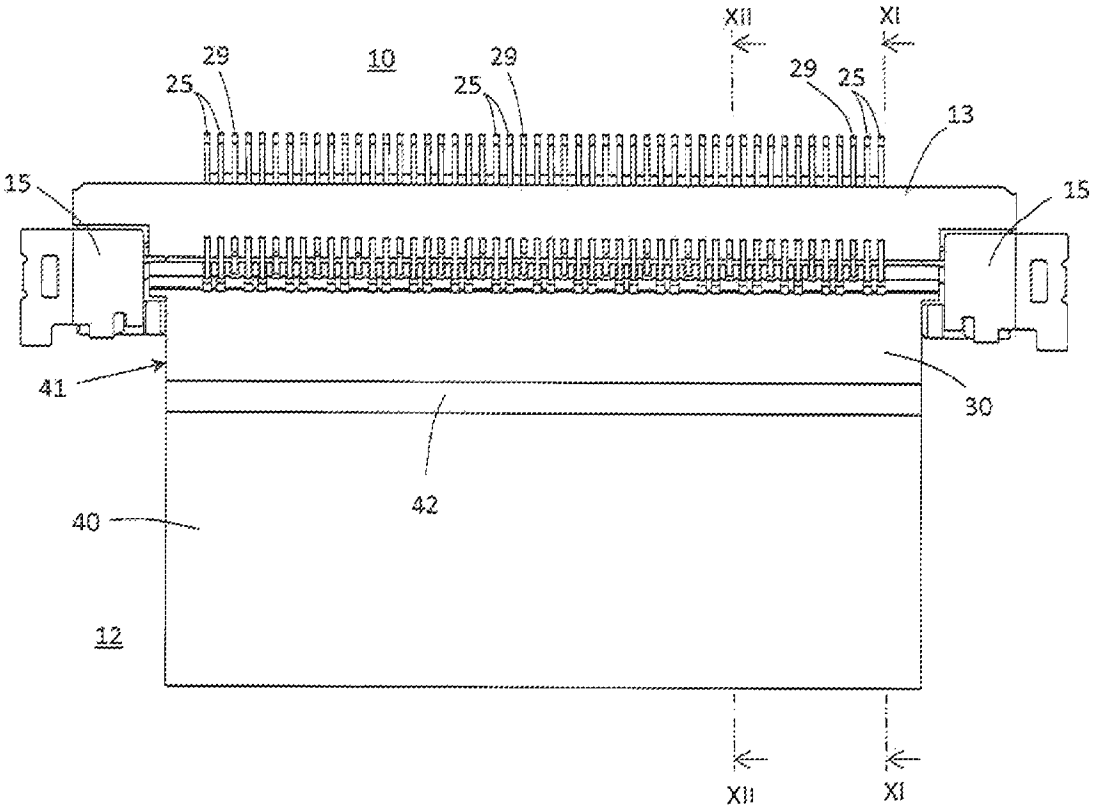
FIG. 10 is a schematic plan view showing a condition wherein the FPC is put partially in the embodiment of electrical connector and the actuator of the embodiment of electrical connector is put in the second station.

The actuator 30 is postured to take up first and second stations selectively. In the first station, the actuator 30 keeps rising from the housing 13, as shown in FIGS. 1 to 3, and in the second station, the actuator 30 keeps lying down on the housing 13, as shown in FIGS. 9 and 10 described later. Then, the actuator 30 is rotated to shift from the first station to the second station or from the second station to the first station.

A part of the actuator 30, which is caused to face the plane portion 18 of the housing 13 when the actuator 30 is put in the second station, is provided thereon with a plurality of pressing portions 31 to be arranged along the contact-arrangement direction, that is, the longitudinal direction of the housing 13. The pressing portions 31 thus provided on the actuator 30 are operative to press down the FPC 12 inserted through the opening 17 into the housing 13 to be put partially in the same to the contacting portions 24*a*, each of which is provided on the arm 24 of the first conductive contact 20 put in the groove 19 provided on the plane portion 18 of the housing 13 to be project from the groove 19 to the outside of the plane portion 18, and the contacting portions 28*a*, each of which is provided on the arm 28 of the second conductive contact 21 put in the groove 19 provided on the plane portion 18 of the housing 13 to be project from the groove 19 to the outside of the plane portion 18, when the actuator 30 is put in the second station under a condition wherein the FPC 12 is put partially in the housing 13.

The pressing portions 31 provided on the actuator 30 are positioned to opposite respectively to the grooves 19 provided on the plane portion 18 of the housing 13 when the actuator 30 is put in the second station. Thereby, each of the pressing portions 31 is positioned to opposite to either a corresponding one of the contacting portions 24*a* each provided on the arm 24 of the first conductive contact 20 put in the groove 19 or a corresponding one of the contacting portions 28*a* each provided on the arm 28 of the second conductive contact 21 put in the groove 19 with the FPC 12 between each of the pressing portions 31 and each of the contacting portions 24*a* or the contacting portions 28*a* and operative to press down the FPC 12 to the contacting portion 24*a* or the contacting portion 28*a* when the actuator 30 is put in the second station under the condition wherein the FPC 12 is put partially in the housing 13. Consequently, the FPC 12 is able to be suitably and surely pressed down to the contacting portions 24*a*, each of which is provided on the arm 24 of the first conductive contact 20 put in the groove 19 provided on the plane portion 18 of the housing 13 to be project from the groove 19 to the outside of the plane portion 18, and the contacting portions 28*a*, each of which is provided on the arm 28 of the second conductive contact 21 put in the groove 19 provided on the plane portion 18 of the housing 13 to be project from the groove 19 to the outside of the plane portion 18, by the pressing portions 31 provided on the actuator 30.

The actuator 30 is provided with, in addition to the pressing portions 31, a plurality of engaging portions 33, each of which is formed into an axis-like portion and with each of which the supporting portion 23*a* provided on the arm 23 of the first conductive contact 20 to be formed into the hook-shaped portion engages for supporting the actuator 30, as shown in FIG. 4. That is, each of the first conductive contacts 20 engages with a corresponding one of the engaging portion 33 of the actuator 30. Therefore, the actuator 30 is supported by the supporting portion 23*a*, each of which is provided on the arm 23 of the first conductive contact 20 and engages with the engaging portion 33 of the actuator 30, to be rotatable in regard to the housing 13 about an imaginary axis extending along the lengthwise direction of the actuator 30 for taking up selectively the first station wherein the actuator 30 keeps rising from the housing 13 and the second station wherein the actuator 30 keeps lying down on the housing 13.

As described above, since the actuator 30 is supported to be rotatable in regard to the housing 13 by the supporting portions 23*a*, each of which is provided on the arm 23 of the first conductive contact 20 for engaging with the engaging portion 33 of the actuator 30, any hindrance on manipulation of the actuator 30 for rotating the actuator 30 from the first station to the second station or from the second station to the first station can be avoided even when the actuator 30 is deformed to warp in a direction perpendicular to the contact arrangement direction.

When the actuator 30 thus supported by the supporting portion 23*a* provided on each of the arm 23 of the first conductive contact 20 is rotated in regard to the housing 13 to shift from the first station to the second station under the condition wherein the FPC 12 is put partially in the housing 13, the pressing portions 31 provided on the actuator 30, each of which is positioned to opposite to either the corresponding one of the contacting portions 24*a* each provided on the arm 24 of the first conductive contact 20 put in the groove 19 or the corresponding one of the contacting portions 28*a* each provided on the arm 28 of the second conductive contact 21 put in the groove 19 with the FPC 12 between each of the pressing portions 31 and each of the contacting portions 24*a* or the contacting portions 28*a*, are operative to press down the FPC 12 to the contacting portions 24*a* or the contacting portions 28*a*.

The actuator 30 is further provided with a plurality of projecting portions 34, each of which faces the second conductive contact 21 at a location in the vicinity of the stopper portion 27*a* provided on the arm 27 of the second conductive contact 21, as shown in FIG. 5. The projecting portions 34 of the actuator 30 has a slant surface 34*a* which faces the stopper portion 27*a* provided on the arm 27 of the second conductive contact 21 when the actuator 30 is put in the first station or positioned in the vicinity of the first station.

The slant surface 34*a* of the projecting portions 34 is operative to come into contact with the stopper portion 27*a* provided on the arm 27 of the second conductive contact 21 to be formed into the protrusion having the curved surface when the actuator 30 put in the first station or positioned in the vicinity of the first station is distorted to shift partially toward the arm 24 of the first conductive contact 20 and the arm 28 of the second conductive contact 21, so that the projecting portions 34 is shifted from the stopper portion 27*a* in the insertion direction of the FPC 12 along which the FPC 12 is inserted into the housing 13 through the opening 17 provided thereon with the partial shift of the actuator 30 toward the arm 24 of the first conductive contact 20 and the arm 28 of the second conductive contact 21.

In addition, the actuator 30 is also provided with a pair of locking portions 35 at side end portions of the actuator 30 opposite to each other in such a manner that that the pressing portions 31 are arranged along the contact-arrangement direction between the locking portions 35. The locking portions 35 are operative to engage with the FPC 12 so as to lock the same when the actuator 30 is rotated to shift from the first station to the second station under the condition wherein the FPC 12 is put partially in the housing 13.

As for the FPC 12 which is to be inserted into the housing 13 through the opening 17 provided thereon to be put partially in the housing 13, at an end portion of a tabular body 40 of the FPC 12, a terminal board portion 41 is provided to be put in the housing 13 for facing the plane portion 18 of the housing 13. On a surface 43 (for convenience' sake, referred to as a lower surface 43) opposite to a surface 42 (for convenience' sake, referred to as an upper surface 42) of the terminal board portion 41 shown in FIGS. 1 and 2, the contacting terminals 44 (shown in FIGS. 4 and 5) are arranged in a direction perpendicular to the insertion direction of the FPC 12 along which the FPC 12 is inserted through the opening 17 into the housing 13.

On side edge portions of the terminal board portion 41 opposite to each other in the direction along which the contacting terminals 44 are arranged, a pair of cut-out spaces 45 formed respectively by cutting out pieces from the terminal board portion 41 are provided. When the actuator 30 takes up the second station under the condition wherein the FPC 12 is put partially in the housing 13, the locking portions 35 provided on the actuator 30 engage respectively with the cut-out spaces 45 provided on the terminal board portion 41 of the FPC 12 so as to lock the FPC 12, so that the FPC 12 is maintained stably to be put partially in the housing 13.

Figure 6:
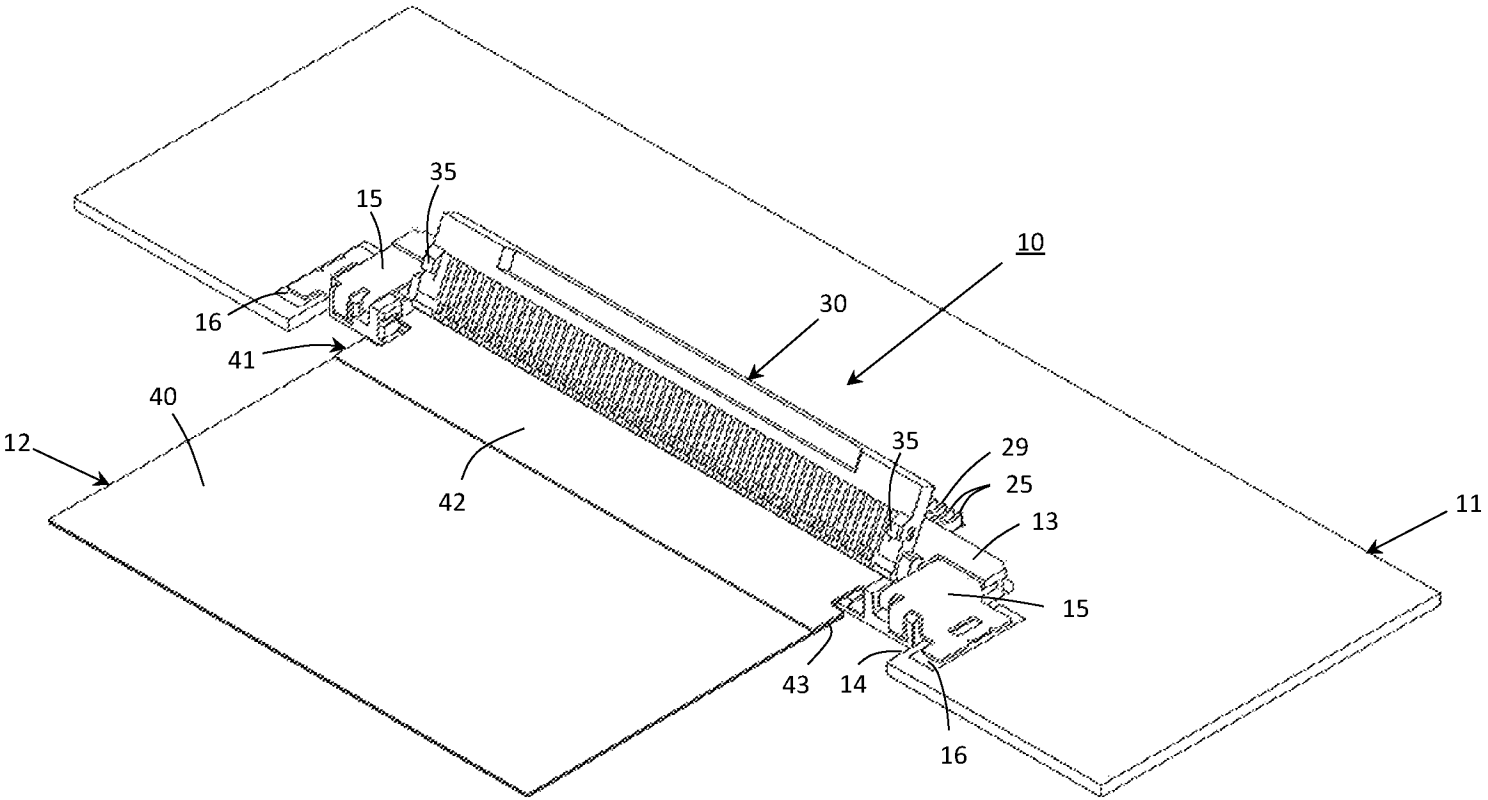
FIG. 6 is a schematic perspective view showing a condition wherein the FPC is put partially in the embodiment of electrical connector fixed to the circuit board device and an actuator of the embodiment of electrical connector is put in a first station.
Figure 7:
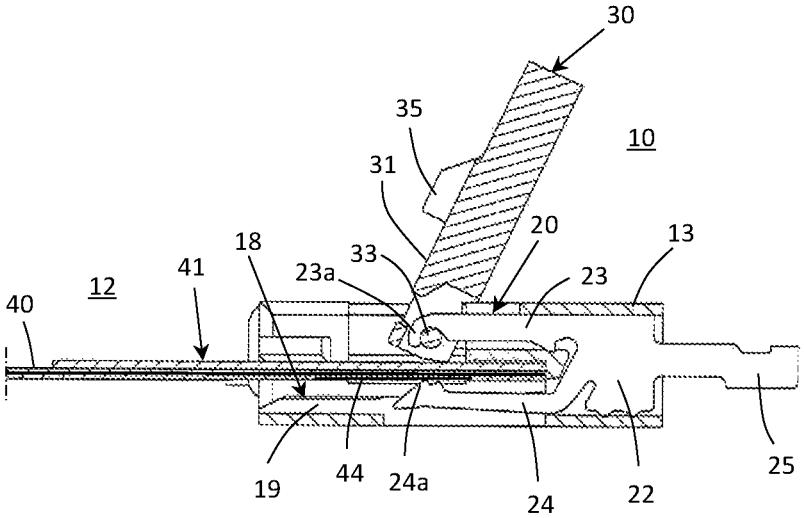
FIG. 7 is a schematic cross sectional view showing a condition wherein the FPC is put partially in the embodiment of electrical connector in which the actuator is put in the first station.
Figure 8:
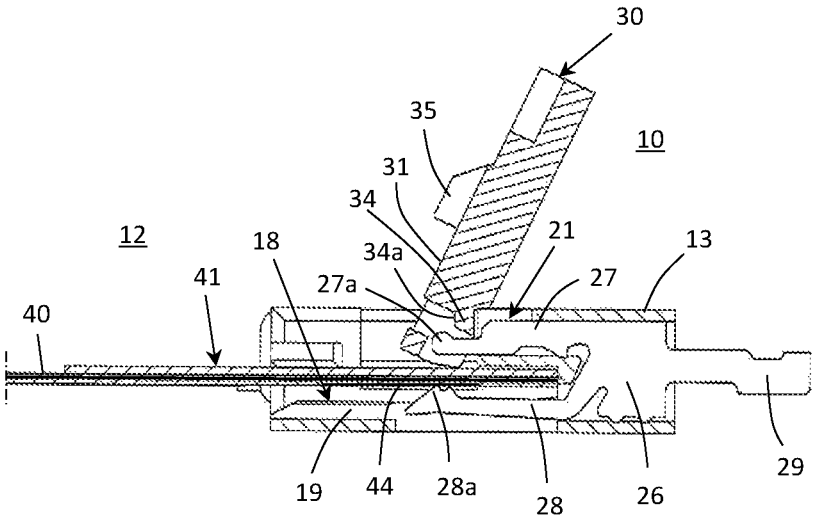
FIG. 8 is a schematic cross sectional view showing a condition wherein the FPC is put partially in the embodiment of electrical connector in which the actuator is put in the first station.

In the electrical connector 10 described above, under the condition wherein the actuator 30 is put in the first station, the FPC 12 provided in such a manner as shown in FIGS. 1 and 2 as the flat circuit device is inserted into the housing 13 through the opening 17 provided thereon so that the terminal board portion 41 of the FPC 12 is put in the housing 13. When the insertion of the FPC 12 into the housing 13 has been completed, the terminal board portion 41 of the FPC 12 put in the housing 13 is operative to cover the plane portion 18 of the housing 13 so that the plane portion 18 of the housing 13 is opposite closely to the lower surface 43 of the terminal board portion 41 of the FPC 12, as shown in FIGS. 6 to 8.

Under a condition wherein the terminal board portion 41 of the FPC 12 is thus put in the housing 13, the contacting portion 24*a* which is provided on the arm 24 of each of the first conductive contact 20 put in the groove 19 provided on the plane portion 18 of the housing 13 to be project from the groove 19 to the outside of the plane portion 18 and the contacting portion 28*a* which is provided on the arm 28 of each of the second conductive contact 21 put in the groove 19 provided on the plane portion 18 of the housing 13 to be project from the groove 19 to the outside of the plane portion 18, take positions corresponding respectively to the contacting terminals 44 arranged on the lower surface 43 of the terminal board portion 41 of the FPC 12. At that time, each of the contacting portions 24*a* and 28*a* is put in contact with the corresponding one of the contacting terminals 44, as shown in FIGS. 7 and 8.

Figure 11:
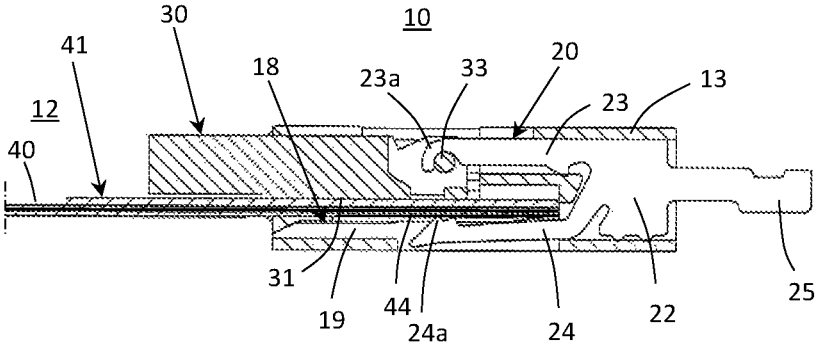
FIG. 11 is a schematic cross sectional view taken along line XI-XI in FIG. 10.
Figure 12:
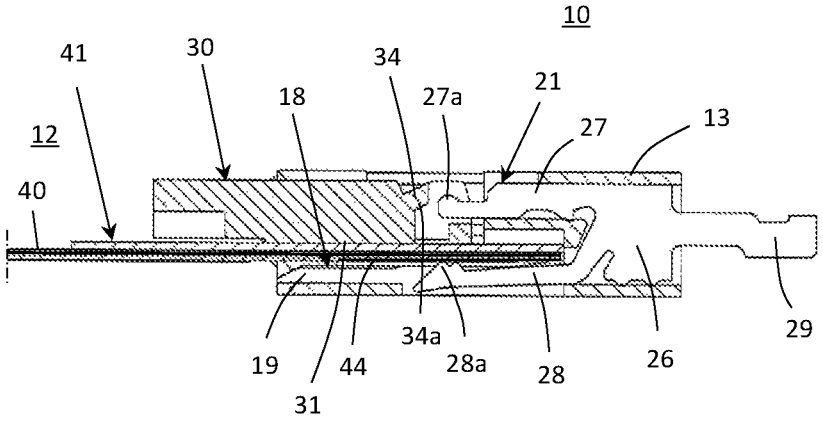
FIG. 12 is a schematic cross sectional view taken along line XII-XII in FIG. 10.

After that, when the actuator 30 is rotate about the imaginary axis extending along the lengthwise direction of the actuator 30 for shifting from the first station to the second station so as to be put in the second station, as shown in FIGS. 9 and 10, the pressing portions 31 arranged on the actuator 30 are operative to press down the terminal board portion 41 of the FPC 12 put in the housing 13 to the contacting portions 24*a*, each of which is provided on the arm 24 of the first conductive contact 20 put in the groove 19 provided on the plane portion 18 of the housing 13 to be project from the groove 19 to the outside of the plane portion 18, and the contacting portions 28*a*, each of which is provided on the arm 28 of the second conductive contact 21 put in the groove 19 provided on the plane portion 18 of the housing 13 to be project from the groove 19 to the outside of the plane portion 18, as shown in FIG. 11 showing a cross section taken along line XI-XI in FIG. 10 and FIG. 12 showing a cross section taken along line XII-XII in FIG. 10. Thereby, the contacting portions 24*a* provided on the arm 24 of each of the first conductive contacts 20 and the contacting portions 28*a* provided on the arm 28 of each of the second conductive contacts 21 are put in press-contact respectively with the contacting terminals 44 arranged on the lower surface 43 of the terminal board portion 41 of the FPC 12, so that the first conductive contacts 20 each having the contacting portion 24*a* and the second conductive contacts 21 each having the contacting portion 28*a* are put in electrical connection with the contacting terminals 44 on the FPC 12.

Under the above-mentioned situation, since the pressing portions 31 provided on the actuator 30, each of which is positioned to opposite to either the corresponding one of the contacting portions 24*a* each provided on the arm 24 of the first conductive contact 20 put in the groove 19 or the corresponding one of the contacting portions 28*a* each provided on the arm 28 of the second conductive contact 21 put in the groove 19 with the terminal board portion 41 of the FPC 12 between each of the pressing portions 31 and each of the contacting portions 24*a* or the contacting portions 28*a*, are operative to press down the terminal board portion 41 of the FPC 12 to the contacting portions 24*a* or the contacting portions 28*a*, the contacting portions 24*a* each provided on the arm 24 of the first conductive contact 20 put in the groove 19 and the contacting portions 28*a* each provided on the arm 28 of the second conductive contact 21 put in the groove 19 can be suitably and surely put in press-contact respectively with the contacting terminals 44 arranged on the lower surface 43 of the terminal board portion 41 of the FPC 12 by the pressing portions 31 provided on the actuator 30.

On that occasion, the locking portions 35 provided on the actuator 30 engage respectively with the cut-out spaces 45 provided on the terminal board portion 41 of the FPC 12 so as to lock the FPC 12 and thereby the FPC 12 can be maintained stably to be put partially in the housing 13.

Then, when the actuator 30 put in the second station is rotated for shifting from the second station to the first station, as occasion demands, under the condition wherein the terminal board portion 41 of the FPC 12 is put in the housing 13, the FPC 12 is released from the condition of locking by the locking portions 35 provided on the actuator 30 and the terminal board portion 41 of the FPC 12 is released from the condition of pressing by the pressing portions 31 provided on the actuator 30. Consequently, the FPC 12 with the terminal board portion 41 thereof put in the housing 13 can be withdrawn from the housing 13.

In the electrical connector 10 described above, in case a manipulation for causing the actuator 30 to rotate from the first station to the second station under a condition wherein the terminal board portion 41 of the FPC 12 is not put in the housing 13, namely, a vacancy-press operation of the actuator 30 is carried out, the pressing portions 31 provided on the actuator 30 are caused to face directly the plane portion 18 of the housing 13 without the terminal board portion 41 of the FPC 12 between the pressing portions 31 and the plane portion 18. On that occasion, the pressing portions 31 provided on the actuator 30 do not come into contact with the terminal board portion 41 of the FPC 12 and thereby the actuator 30 is likely distorted in such a manner that a central portion of the actuator 30 in the lengthwise direction thereof is caused to shift toward the plane portion 18 of the housing 13.

Figure 13:
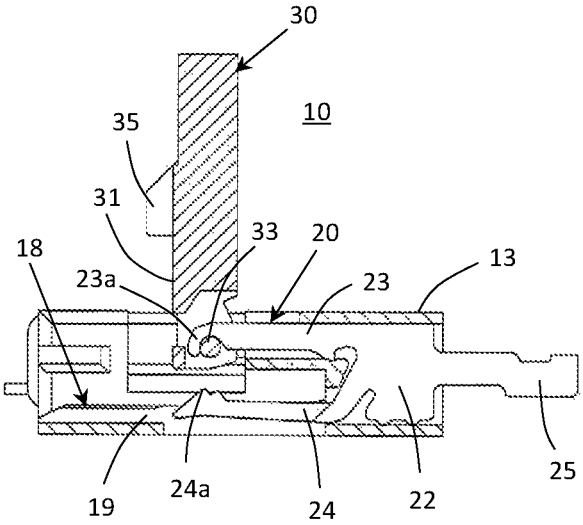
FIG. 13 is a schematic cross sectional view showing a condition wherein the actuator of the embodiment of electrical connector is on the way of shifting from the second station to the first station without any FPC put in the housing of the embodiment of electrical connector.
Figure 14:
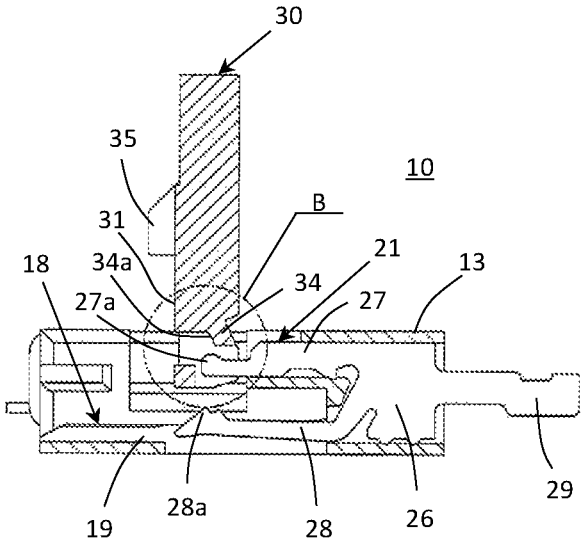
FIG. 14 is a schematic cross sectional view showing a condition wherein the actuator of the embodiment of electrical connector is on the way of shifting from the second station to the first station without any FPC put in the housing of the embodiment of electrical connector.

In the case where the actuator 30 is thus distorted, when the actuator 30 is rotated for shifting from the second station to the first station so as to be positioned in the vicinity of the first station wherein the actuator 30 is perpendicular to the plane portion 18 of the housing 13, as shown in FIGS. 13 and 14, or put in the first station wherein the actuator 30 keeps rising from the housing 13, as shown in FIGS. 1 to 3, it is likely that, since the central portion of the actuator 30 in the lengthwise direction thereof is shifted toward the plane portion 18 of the housing 13, the engaging portion 33 provided on the actuator 30 to be formed into the axis-like portion is disengaged from the supporting portion 23*a* provided on the arm 23 of each of the first conductive contacts 20 to be formed into the hook-shaped portion and, as a result, the actuator 30 as a whole is disengaged from the first and second conductive contacts 20 and 21. However, in reality, the actuator 30 can be prevented from being disengaged from the first and second conductive contacts 20 and 21 in the electrical connector 10, as follows.

Figure 15:
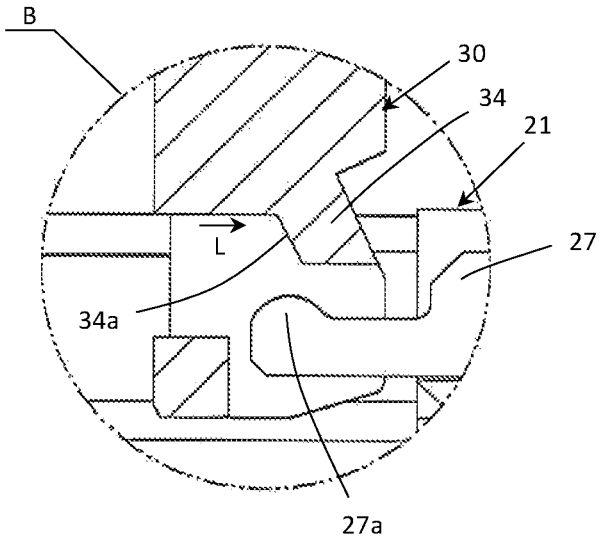
FIG. 15 is a schematic enlarged cross sectional view showing a part of the embodiment of electrical connector appearing in two-dot chain circle B in FIG. 14.

As shown in FIG. 15 showing a part of the electrical connector 10 appearing in two-dot chain circle B in FIG. 14, when the actuator 30 is positioned in the vicinity of the first station wherein the actuator 30 is perpendicular to the plane portion 18 of the housing 13, the slant surface 34*a* of the projecting portion 34 provided on the actuator 30 to be formed into the protrusion having the curved surface faces the stopper portion 27*a* provided on the arm 27 of the second conductive contact 21. Under such a condition, in case the actuator 30 is distorted to cause the central portion thereof to shift toward the arm 24 of each of the first conductive contacts 20 and the arm 28 of each of the second conductive contacts 21, the slant surface 34*a* of the projecting portion 34 provided on the actuator 30 is operative to come into contact with the stopper portion 27*a* provided on the arm 27 of each of the second conductive contacts 21, so that the projecting portion 34 is shifted from the stopper portion 27*a* in the insertion direction of the FPC 12 (shown with an arrow L in FIG. 15) with an action of the slant surface 34*a* of the projecting portion 34 in contact with the stopper portion 27*a*. As a result, the projecting portion 34 provided on the actuator 30 is prevented from shifting in the direction opposite to the insertion direction of the FPC 12 by the stopper portion 27*a* provided on the arm 27 of each of the second conductive contacts 21 and thereby it is resulted in that the actuator 30 as a whole is prevented from being disengaged from the first and second conductive contacts 20 and 21 even when the actuator 30 positioned in the vicinity of the first station or put in the first station is distorted to cause the central portion thereof to shift toward the arm 24 of each of the first conductive contacts 20 and the arm 28 of each of the second conductive contacts 21.

With the electrical connector 10 constituting the embodiment of electrical connector according to the present invention as described above, when the actuator 30 is rotated to shift from the first station to the second station under the condition wherein the FPC 12 is put partially in the housing 13 and thereby the pressing portion 31 provided on the actuator 30 is caused to press down the FPC 12 so that the contacting portions 24*a* of each of the first conductive contacts 20 and the contacting portions 28*a* of each of the second conductive contacts 21 are put in press-contact respectively with the contacting terminals 44 provided on the FPC 12, the actuator 30 is not supported by, for example, a plurality first conductive contacts each engaging with the actuator 30 from the upper side of the same and a plurality of second conductive contacts each engaging with the actuator 30 from the lower side of the same, but supported to be rotatable by the supporting portion 23*a* provided on each of the first conductive contacts 20 for engaging with the engaging portion 33 of the actuator 30, and accordingly, any hindrance on the manipulation of the actuator 30 can be avoided even when the actuator 30 is deformed to warp in the direction perpendicular to the contact-arrangement direction along which the first and second conductive contacts 20 and 21 are arranged.

In addition, with the electrical connector 10, since the actuator 30 is provided thereon the projecting portions 34, each of which faces the corresponding one of the second conductive contacts 21, and each of the second conductive contacts 21 is provided thereon with the stopper portion 27*a* for engaging with the projecting portion 34 of the actuator 30 so as to prevent the projecting portion 34 from shifting in the direction opposite to the insertion direction of the FPC 12 when the actuator 30 is distorted on the occasion of taking up the first station, the actuator 30 can be prevented from shifting in the direction opposite to the insertion direction of the FPC 12 along which the FPC 12 is inserted into the housing 13 through the opening 17 provided thereon so as to be disengaged from the first and second conductive contacts 20 and 21 even when the vacancy-press operation is carried out and then the actuator 30 is caused to rotate for shifting from the second station to the first station under the condition wherein the terminal board portion 41 of the FPC 12 is not put in the housing 13 so that the actuator 30 is distorted on the occasion of taking up the first station.

Further, in the electrical connector 10, since the first and second conductive contacts 20 and 21 are positioned in the manner that the second conductive contacts 21 appear at intervals of the predetermined number of the first conductive contacts 20, wherein the manner of arrangement in which the first and second conductive contacts 20 and 21 appear alternately is included, the condition wherein the actuator 30 is supported to be rotatable by the supporting portion 23*a* provided on each of the first conductive contacts 20 for engaging with the engaging portion 33 provided on the actuator 30 and the condition wherein the actuator 30 is prevented from shifting in the direction opposite to the insertion direction of the FPC 12 by the stopper portion 27*a* provided on each of the second conductive contacts 21 put in engagement with the projecting portion 34 provided on the actuator 30, are obtained in the well-balanced manner over the arrangement of the first and second conductive contacts 20 and 21 on the housing 13 on the whole. Then, since each of the engaging portions 33 provided on the actuator 30 is formed into the axis-like portion and the supporting portion 23*a* provided on each of the first conductive contacts 20 is formed into the hook-shaped portion, the actuator 30 is more surely supported by the first conductive contacts 20 each having the supporting portion 23*a* provided for engaging with the engaging portion 33 provided on the actuator 30. Besides, since the projecting portion 34 provided on the actuator 30 has the slant surface 34*a* which faces the stopper portion 27*a* provided on each of the second conductive contacts 21 when the actuator 30 is put in the first station or positioned in the vicinity of the first station, the stopper portion 27*a* provided on each of the second conductive contacts 21 comes into contact with the slant surface 34*a* of the projecting portion 34 provided on the actuator 30 when the actuator 30 is distorted on the occasion of taking up the first station and thereby the actuator 30 is more surely and smoothly prevented from shifting in the direction opposite to the insertion direction of the FPC 12 by the stopper portion 27*a* provided on each of the second conductive contacts 21 in contact with the slant surface 34*a* of the projecting portion 34 provided on the actuator 30.

The invention claimed is:

1. An electrical connector comprising:

a housing made of insulator to have a plane portion facing an opening through which a flat circuit device is inserted along a predetermined insertion direction to be put partially in the housing, a plurality of first and second conductive contacts arranged on the housing in a predetermined manner of arrangement, each of which has a contacting portion for coming into contact with a corresponding one of contacting terminals provided on the flat circuit device put partially in the housing, and an actuator provided to be rotatable in regard to the housing for shifting either from a first station to a second station or from the second station to the first station and to have a pressing portion for pressing down the flat circuit device put partially in the housing to the contacting portions of the first and second conductive contacts, said pressing portion being caused to press down the flat circuit device so that the contacting portions of the first and second conductive contacts are put in press-contact respectively with the contacting terminals provided on the flat circuit device when the actuator is rotated to shift from the first station to the second station under a condition wherein the flat circuit device is put partially in the housing, wherein said actuator is provided with an engaging portion for engaging with said first conductive contact and a projecting portion for facing said second conductive contact, and wherein said first conductive contact is provided with a supporting portion for engaging with said engaging portion so as to support said actuator and said second conductive contact is provided with a stopper portion for engaging with said projecting portion so as to prevent said projecting portion from shifting in a direction opposite to the predetermined insertion direction of the flat circuit device when said actuator is distorted and so positioned in the vicinity of the first station as to be perpendicular to the plane portion of the housing on the occasion of taking up the first station, wherein said engaging portion provided on said actuator is formed into an axis-like portion and said supporting portion provided on said first conductive contact is formed into a hook-shaped portion.

2. An electrical connector according to claim 1, wherein said first and second conductive contacts are positioned in such a manner that said second conductive contacts appear at intervals of a predetermined number of said first conductive contacts in the arrangement of said first and second conductive contacts on the housing.

3. An electrical connector according to claim 2, wherein said first and second conductive contacts appear alternately in the arrangement of said first and second conductive contacts on the housing.

4. An electrical connector according to claim 1, wherein the contacting portions of said first and second conductive contacts are provided on a part of the housing placed to face the pressing portion of said actuator when said actuator is put in the second station.

5. An electrical connector according to claim 1, wherein said actuator has a lengthwise direction coincident with a direction along which said first and second conductive contacts are arranged, and said actuator is operative to rotate about an imaginary axis extending along said lengthwise direction for shifting from the first station to the second station or from the second station to the first station.

6. An electrical connector according to claim 1, wherein said projecting portion provided on said actuator is provided with a slant surface which faces said stopper portion provided on said second conductive contact when said actuator is put in the first station or positioned in the vicinity of the first station.

* * * * *